US006286232B1

(12) United States Patent
Snyder et al.

(10) Patent No.: US 6,286,232 B1
(45) Date of Patent: Sep. 11, 2001

(54) PREGNANCY/MATERNITY INSOLES

(75) Inventors: Daniel B. Snyder, Collierville; Laura Crane, Williston, both of TN (US)

(73) Assignee: Schering-Plough Healthcare, Inc., Memphis, TN (US)

( * ) Notice: Subject to any disclaimer, the term of this patent is extended or adjusted under 35 U.S.C. 154(b) by 0 days.

(21) Appl. No.: 09/493,577

(22) Filed: Jan. 28, 2000

(51) Int. Cl.[7] ..... A43B 13/38

(52) U.S. Cl. ..... 36/43; 36/44; 36/142; 36/145; 36/173

(58) Field of Search ..... 36/43, 44, 142, 36/143, 144, 166, 145, 173

(56) References Cited

U.S. PATENT DOCUMENTS 1,144,291 * 6/1915 Boyer ..... 36/43
3,990,159 * 11/1976 Borgeas ..... 36/101
4,272,899 * 6/1981 Brooks ..... 36/129
4,747,410 * 5/1988 Cohen ..... 36/43
5,174,052 * 12/1992 Schoenhaus et al. ..... 36/144
5,611,153 * 3/1997 Fisher et al. ..... 36/43
5,669,162 * 9/1997 Dyer ..... 36/44
5,746,011 * 5/1998 Hedstrom ..... 36/44

* cited by examiner

*Primary Examiner*—M D Patterson
(74) *Attorney, Agent, or Firm*—Robert J. Lipka

(57) ABSTRACT

A removable insole for insertion into footwear, includes a forefoot portion for extending at least to metatarsals of a foot; a cupped heel portion having a varus of approximately 7 degrees for the left foot and approximately 5 degrees for the right foot, which slopes from a medial side of the insole to a lateral side of the insole; a medial arch portion connecting together the forefoot portion and the heel portion, and which extends forwardly to approximately a first metatarsal of a foot supported thereby, and extends rearwardly of a front section of the heel portion; an upper surface extending along the forefoot, arch and heel portions, and having a downward inclination from the heel portion to a front section of the arch portion of approximately 2 degrees; and a lateral flange extending around a periphery of at least the heel portion and extending forwardly at least to a midfoot portion of the insole to prevent abduction of a foot supported thereby.

20 Claims, 6 Drawing Sheets

PREGNANCY/MATERNITY INSOLES

BACKGROUND OF THE INVENTION

The present invention relates generally to shoe insoles, and more particularly, to improved insoles particularly adapted for pregnant women.

Up to eighty percent of pregnant women suffer from lower back pain. In addition, hip, leg, arch and heel pain are also common. Further, there is a significant increase in the severity and frequency of back, hip, leg and foot pain between the second and third trimesters.

As a result of this pain, and further due to physiological changes associated with pregnancy, such as an increase in weight, a change in weight distribution, tissue and joint laxity, changes in hormones, etc., women progressively alter their posture and gait, in an attempt to alleviate this pain.

In addition to the relation between increasing girth and increasing body mass relative to back pain, it has been found by the inventors herein that a statistically significant correlation exists between the severity and frequency of lower back pain and increasing pressure in the arch region, resulting in overpronation, that is, excessive flattening of the longitudinal arch of the foot. Further, it has been discovered by the inventors herein that, although not correlating with back pain, there is an increase in the pressure and time spent in the forefoot region by pregnant women.

U.S. Pat. No. 4,408,402 to Looney discloses a supportive shoe and insert which compensates for changes in body weight and center of gravity which occur during pregnancy. Specifically, Looney provides increased support to specific areas of the foot. Looney teaches that, due to the increase in weight of a pregnant woman during pregnancy, the center of gravity of the woman shifts forward, thereby necessitating an increase in weight toward the back of the shoe to compensate for this forward shift. This at least suggests a rearward tilt of the insole. However, the inventors herein have found that an insole with an elevated forefoot relative to the heel, similar to that suggested by Looney, results in increased back, hip, leg and foot pain, contrary to the desired results recited in Looney.

U.S. Pat. No. 5,174,052 to Schoenhaus et al discloses a dynamic stabilizing inner sole system in which the inner sole is cut away at the center so as to form a substantially U-shaped section which extends to the heel and arch, but does not extend to the forefoot. The longitudinal center of the inner sole is cut away so that there is no effective tilt to the foot, no cushioning at the forefoot, and little cushioning at the heel. This patent also discloses a 5 varus at the heel, but this varus terminates at the center of the heel and does not extend to the lateral side. This insole was tested on pregnant women and was found not be very effective in relieving back and leg pain.

SUMMARY OF THE INVENTION

Accordingly, it is an object of the present invention to provide an insole that overcomes the problems with the aforementioned prior art.

It is another object of the present invention to provide an insole that relieves lower back, hip, leg and foot pain during pregnancy.

It is still another object of the present invention to provide an insole which reduces or eliminates overpronation.

It is still another object of the present invention to provide an insole that reorients the foot to provide correction at all portions of the stride.

In accordance with an aspect of the present invention, a removable insole for insertion into footwear, includes a forefoot portion for extending at least to metatarsals of a foot; a heel portion having a varus in the range of approximately 2 degrees to 9 degrees which slopes from a medial side of the insole to a lateral side of the insole; a medial arch portion connecting together the forefoot portion and the heel portion; and an upper surface extending along the forefoot, arch and heel portions, and having a downward inclination from the heel portion to a front section of the arch portion in a range greater than zero degrees and not greater than approximately 5 degrees.

The downward inclination is preferably approximately 2 degrees.

In one embodiment, the varus is in the range of approximately 2 degrees to 7 degrees for both left and right feet, and preferably approximately 5 degrees for both left and right feet. In another embodiment, the varus is in the range of approximately 3 degrees to 9 degrees for a left foot and approximately 2 degrees to 7 degrees for a right foot, and preferably approximately 7 degrees for the left foot and approximately 5 degrees for the right foot. To accomplish this, the heel portion is thicker at the medial side of the insole than at the lateral side of the insole.

Also, the heel portion is cupped to maintain the heel in order for the varus to operate on the heel of the foot supported thereby. The cupped heel portion is formed by a relatively flat central portion and a sloped side wall.

Still further, the medial arch portion extends forwardly to approximately the first metatarsal of the foot supported thereby, and extends rearwardly of the front section of the heel portion.

A lateral flange extends around the periphery of at least the heel portion and extends forwardly at least to a midfoot portion of the insole to prevent abduction of the foot supported thereby.

In addition, a top cover is secured to the upper surface, and at least one pattern trim line is formed at the forefoot portion for trimming the insole to fit into smaller size footwear.

In accordance with another embodiment of the present invention, footwear includes an outer sole; an inner sole connected to the outer sole, the inner sole including a forefoot portion for extending at least to metatarsals of a foot, a heel portion having a varus in the range of approximately 2 degrees to 9 degrees which slopes from a medial side of the inner sole to a lateral side of the inner sole, a medial arch portion connecting together the forefoot portion and the heel portion, and an upper surface extending along the forefoot, arch and heel portions, and having a downward inclination from the heel portion to a front section of the arch portion in a range greater than zero degrees and not greater than approximately 5 degrees; and an upper connected to at least one of the outer sole and the inner sole.

In accordance with still another aspect of the present invention, a method for relieving back and/or leg pain in pregnant women, includes the steps of providing a varus of a heel of a foot in the range of approximately 2 degrees to 9 degrees which slopes from a medial side of the heel to a lateral side of the heel; supporting a medial arch of the foot in a raised, supported condition; and downwardly inclining the foot from the heel to a front section of medial arch in a range greater than zero degrees and not greater than approximately 5 degrees.

The above and other features of the invention will become readily apparent from the following detailed description thereof which is to be read in connection with the accompanying drawings.

DETAILED DESCRIPTION

Figure 1:
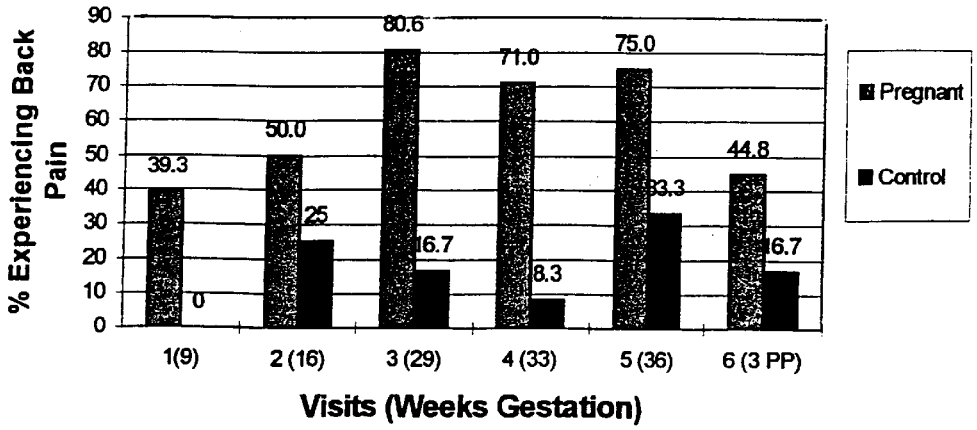
FIG. 1 is a graphical diagram of a percentage of pregnant women experiencing back pain over time.

As discussed above, more than eighty percent of pregnant women suffer from lower back pain, as well as hip, leg, arch and heel pain, with a significant increase in the severity and frequency of the pain between the second and third trimesters. This is shown by FIG. 1 which is the result of a study by the inventors herein of forty-five (45) pregnant women and fifteen (15) non-pregnant women as a control group, during six visits. During these tests, various data were accumulated as to spine profiles, horizontal and vertical center of gravity data and foot pressure distribution data.

Figure 2:
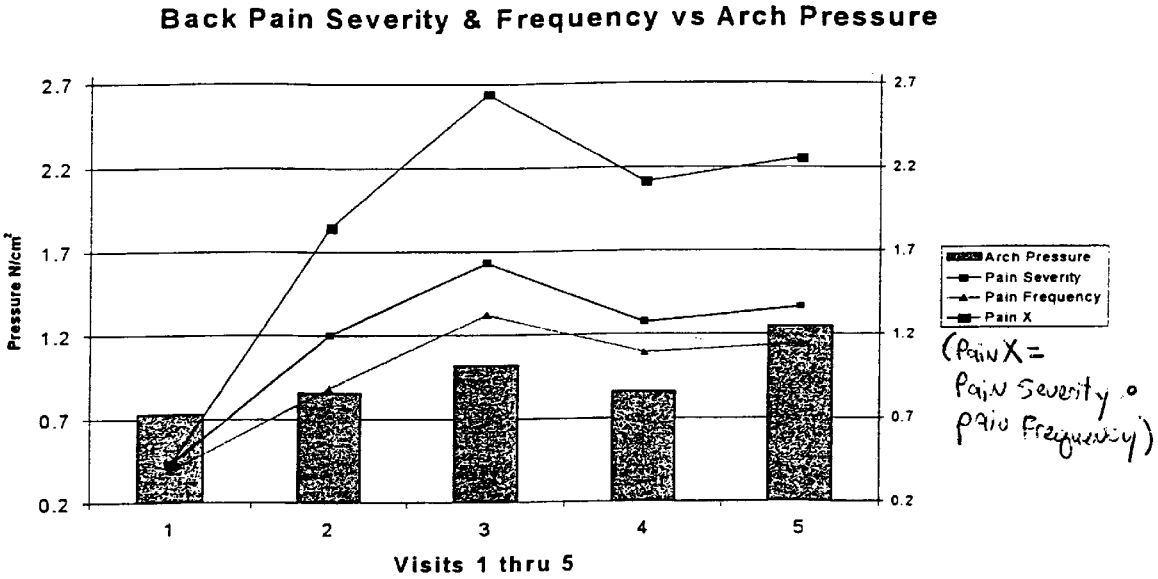
FIG. 2 is a graphical diagram of back pain severity and frequency in relation to arch pressure over time.
Figures 3, 4:
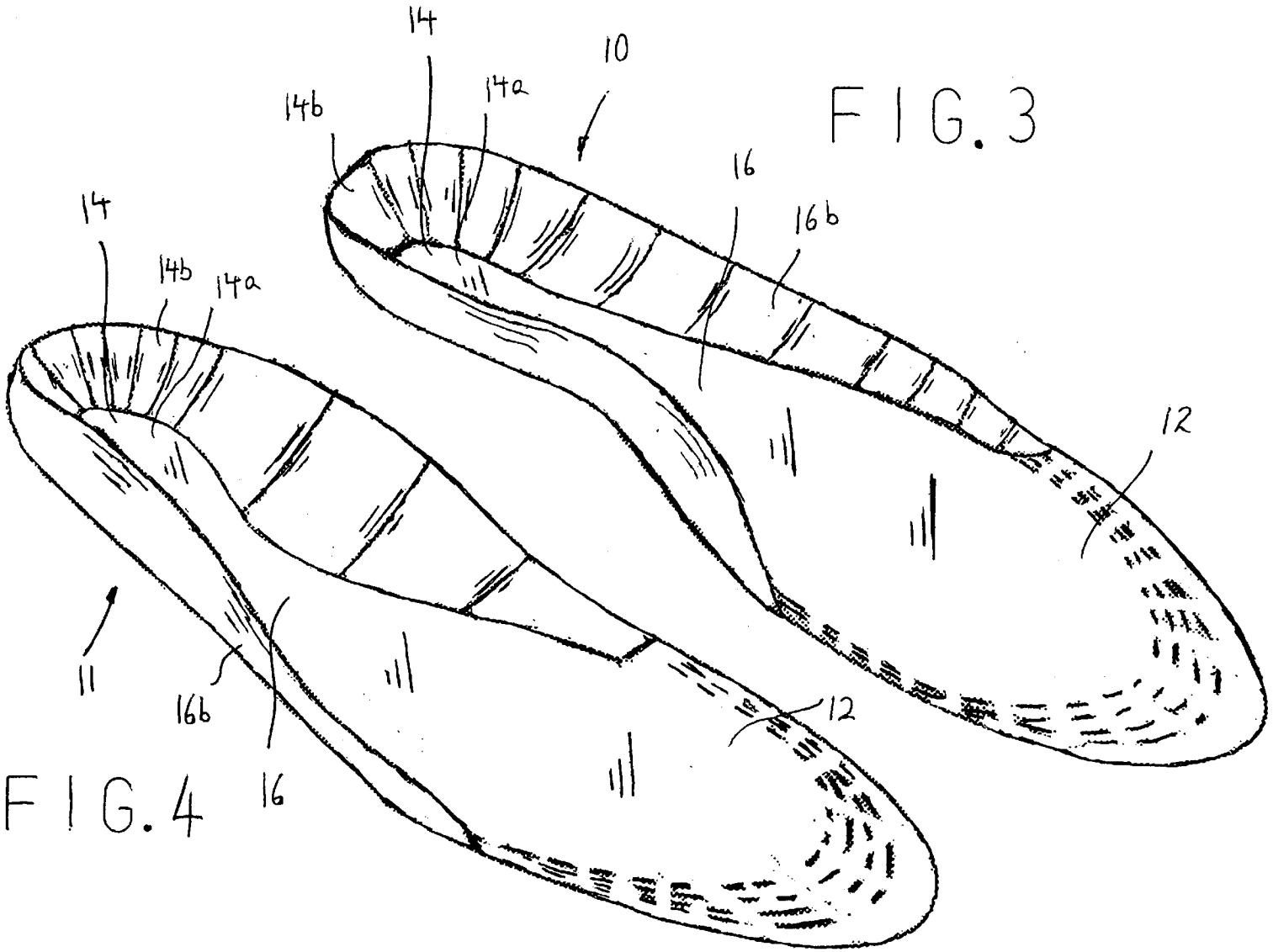
FIG. 3 is a perspective view of a left insole according to the present invention.
FIG. 4 is a perspective view of a right insole according to the present invention.
Figure 5:
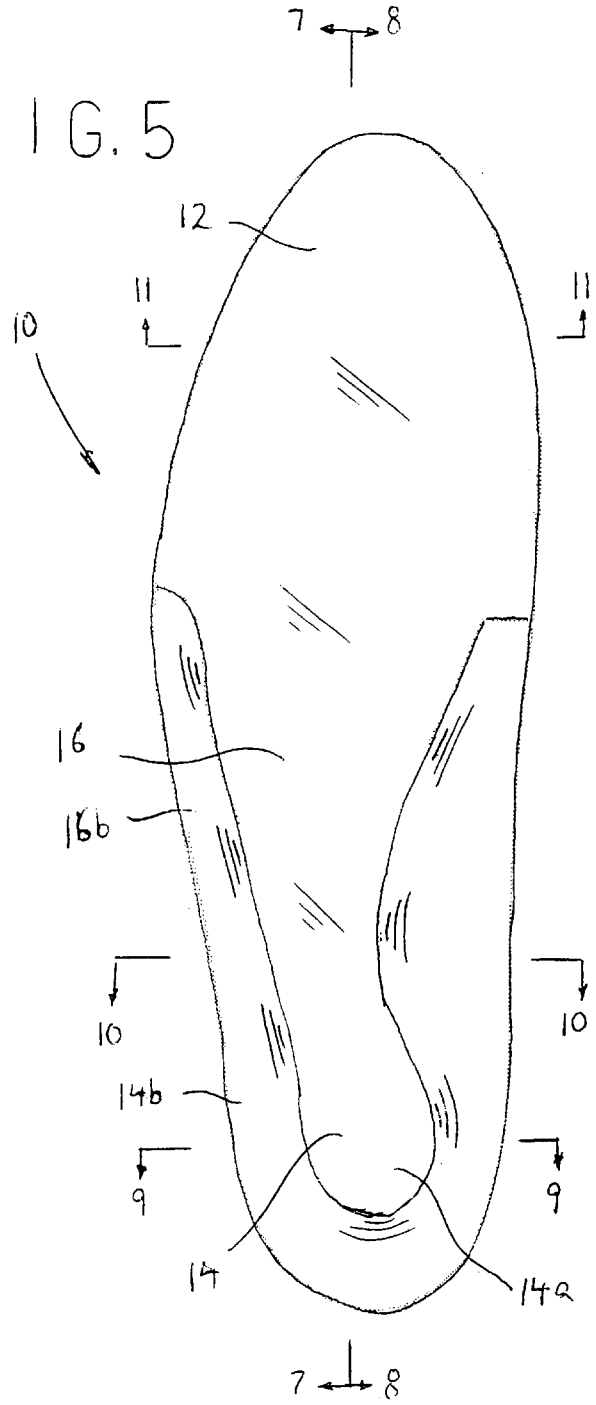
FIG. 5 is a top plan view of the left insole of FIG. 3.
Figure 6:
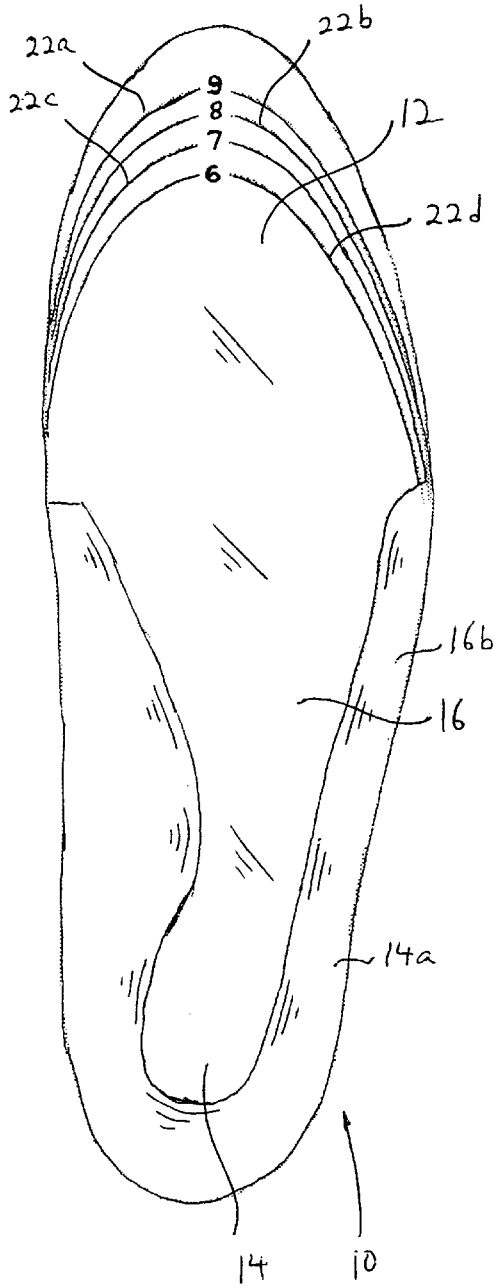
FIG. 6 is a bottom plan view of the left insole of FIG. 3.
Figure 7:
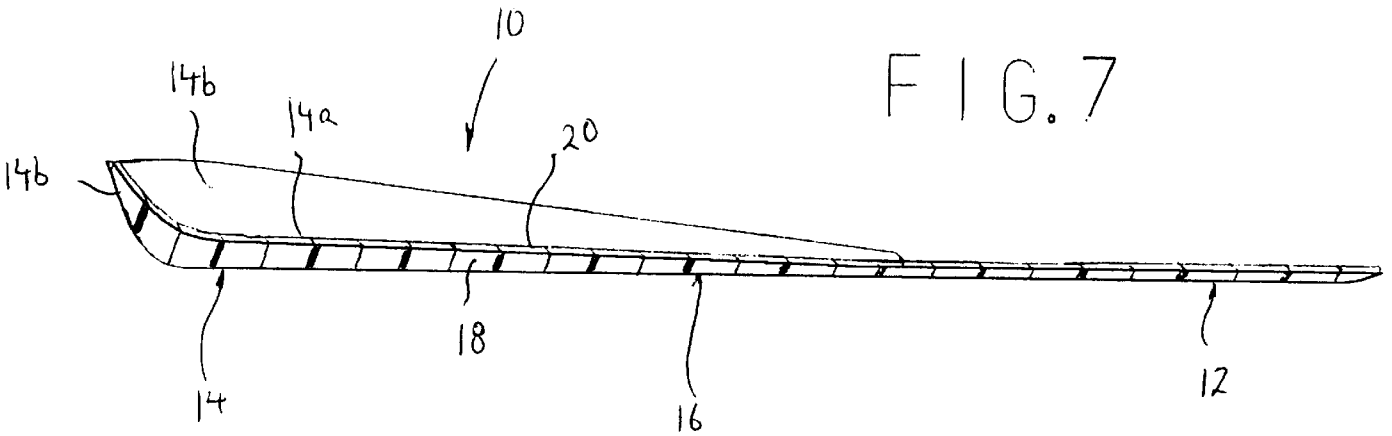
FIG. 7 is a cross-sectional view of the left insole, taken along line 7—7 of FIG. 5.
Figure 8:
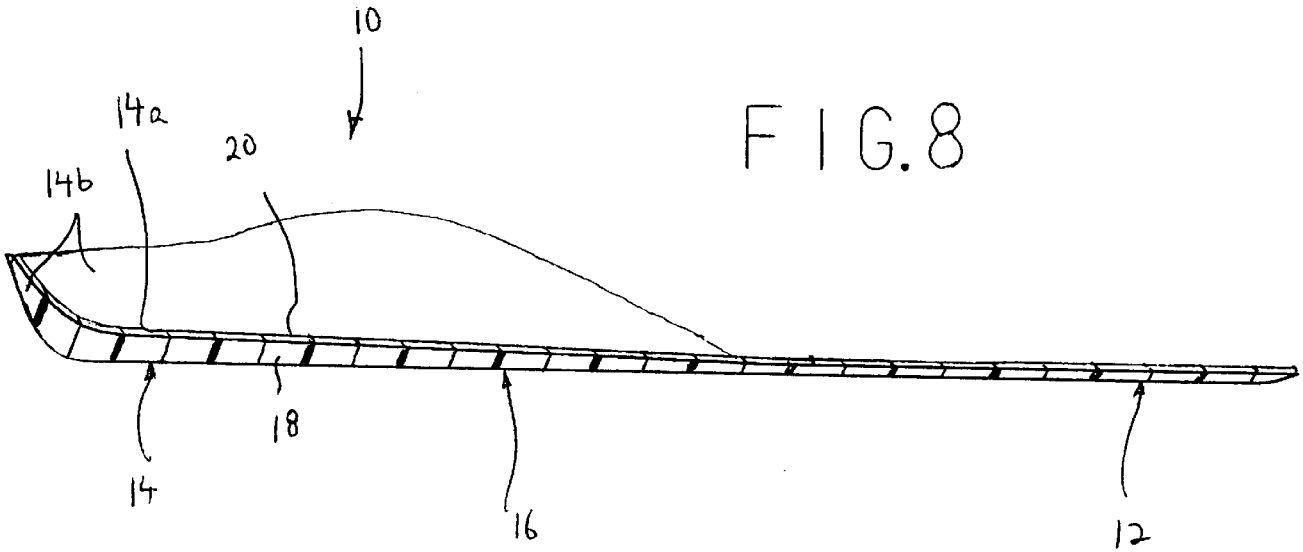
FIG. 8 is a cross-sectional view of the left insole, taken along line 8—8 of FIG. 5.
Figure 9:
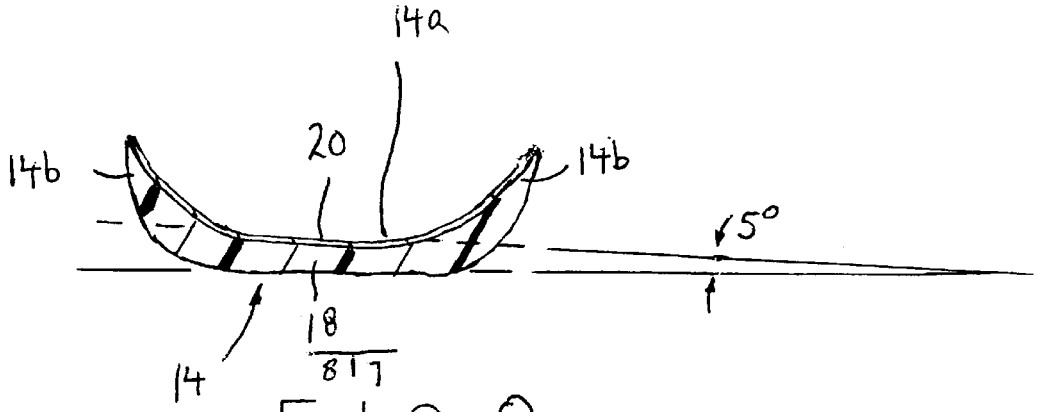
FIG. 9 is a cross-sectional view of the left insole, taken along line 9—9 of FIG. 5.
Figure 10:
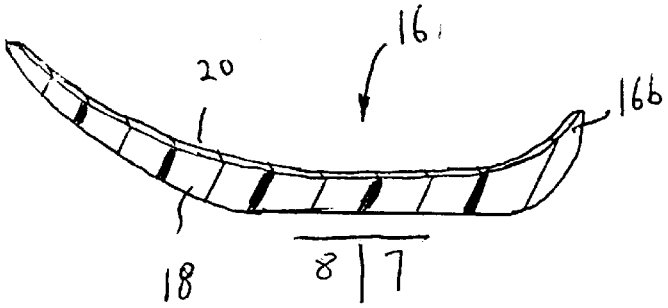
FIG. 10 is a cross-sectional view of the left insole, taken along line 10—10 of FIG. 5.

A key finding in this study was dynamic plantar pressure distribution data which showed a statistically significant correlation between the severity and frequency of lower back pain and increasing pressure in the arch region, resulting in overpronation, that is, excessive flattening of the longitudinal arch of the foot. This is shown in FIG. 2, where the visits 1–5 correspond to the weeks of FIG. 1.

Further, it was discovered by the inventors herein that, although not correlating with back pain, there was an increase in the pressure and time spent in the forefoot region by the pregnant women.

Referring to the drawings in detail, and initially to FIGS. 3–11 thereof, a left insole 10 and a right insole 11 according to a first embodiment of the present invention are adapted to be placed in articles of footwear, as is well known. Insoles 10 and 11 are particularly adapted to alleviate back, hip, leg and foot pain associated with pregnancy. Only the left insole 10 will now be described, with the understanding that right insole 11 can be the mirror image of insole 10, subject to an exception discussed hereinafter.

Specifically, insole 10 has the shape of a human left foot and therefore includes a curved toe or forefoot portion 12, a heel portion 14, and a medial arch portion 16 which connects forefoot portion 12 and heel portion 14 together. Heel portion 14 has a greater thickness than toe portion 12. For example, heel portion 14 may have a thickness of about 6–8 mm, while toe portion may have a thickness of about 1–3 mm.

Insole 10 is formed by a lower layer 18 and a top cover 20 secured to the upper surface of lower layer 18, along forefoot portion 12, cupped heel portion 14 and arch portion 16, by any suitable means, such as adhesive, RF welding, etc.

Lower layer 18 can be made from any suitable material including, but not limited to, any flexible material which can cushion and absorb the shock from heel strike on the insole. Suitable shock absorbing materials can include any suitable foam, such as but not limited to, cross-linked polyethylene, poly(ethylene-vinyl acetate), polyvinyl chloride, synthetic and natural latex rubbers, neoprene, block polymer elastomer of the acrylonitrile-butadiene-styrene or styrene-butadienestyrene type, thermoplastic elastomers, ethylenepropylene rubbers, silicone elastomers, polystyrene, polyurea or polyurethane; most preferably a polyurethane foam made from flexible polyol chain and an isocyanate such as a monomeric or prepolymerized diisocyanate based on 4,4'-diphenylmethane diisocyanate (MDI) or toluene diisocyanate (TDI). Such foams can be blown with freon, water, methylene chloride or other gas producing agents, as well as by mechanically frothing to prepare the shock absorbing resilient layer. Such foams advantageously can be molded into the desired shape or geometry. Non-foam elastomers such as the class of materials known as viscoelastic polymers, or silicone gels, which show high levels of damping when tested by dynamic mechanical analysis performed in the range of −50 degrees C to 100 degrees C may also be advantageously employed. A resilient polyurethane can be prepared from diisocyanate prepolymer, polyol, catalyst and stabilizers which provide a waterblown polyurethane foam of the desired physical attributes. Suitable diisocyanate prepolymer and polyol components include polymeric MDI M-10 (CAS 9016-87-9) and Polymeric MDI MM-103 (CAS 25686-28-6), both available from BASF, Parsippany, N.J.; Pluracol 945 (CAS 9082-00-2) and Pluracol 1003, both available from BASF, Parsippany, N.J.; Multrinol 9200, available from Mobay, Pittsburgh, Pa.; MDI diisocyanate prepolymer XAS 10971.02 and polyol blend XUS 18021.00 available from the Dow Chemical Company, Midland, Mich.; and Niax 34-28, available from Union Carbide, Danbury, Conn. These urethane systems generally contain a surfactant, a blowing agent, and an ultra-violet stabilizer and/or catalyst package. Suitable catalysts include Dabco 33-LV (CAS 280-57-9,2526-71-8), Dabco X543 (CAS Trade Secret), Dabco T-12 (CAS 77-58-7), and Dabco TAC (CAS 107-21-1) all obtainable from Air Products Inc., Allentown, Pa.; Fomrez UL-38, a stannous octoate, from the Witco Chemical Co., New York, N.Y. or A-1 (CAS 3033-62-3) available from OSI Corp., Norcross, Ga. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C., or Givsorb UV-1 (CAS 057834-33-0) and Givsorb UV-2 (CAS 065816-20-8) from Givaudan Corporation, Clifton, N.J. Suitable surfactants include DC-5169 (a mixture), DC190 (CAS68037-64-9), DC197 (CAS69430-39-3), DC-5125 (CAS 68037-62-7) all available from Air Products Corp., Allentown Pa. and L-5302 (CAS trade secret) from Union Carbide, Danbury Conn. Alternatively, lower layer 18 can be a laminate construction, that is, a multilayered composite of any of the above materials. Multilayered composites are made from one or more of the above materials such as a combination of polyethylene vinyl acetate and polyethylene (two layers), a combination of polyurethane and polyvinyl chloride (two layers) or a combination of ethylene propylene rubber, polyurethane foam and ethylene vinyl acetate (3 layers).

Preferably, lower layer 18 is made from a urethane molded material.

Top cover 20 can be made from any suitable material including, but not limited to, fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene-rubber, acrylonitrile-butadiene, acrylonitrile terpolymers and copolymers, vinyls, or other acrylics, as integral top covers. Desirable characteristics of top cover 20 include good durability, stability and visual appearance. It is also desirable that top cover 20 have good flexibility, as indicated by a low modulus, in order to be easily moldable. The bonding surface of top cover 20 should provide an appropriate texture in order to achieve a suitable mechanical bond to the upper surface of lower layer 18. Preferably, the material of top cover 20 is a fabric, such as a brushed knit laminate top cloth (brushed knit fabric/urethane film/non-woven scrim cloth laminate) or a urethane knit laminate top cloth. Preferably, top cover 20 is made from a polyester fabric material.

Lower layer 18 can be prepared by conventional methods such as heat sealing, ultrasonic sealing, radio-frequency sealing, lamination, thermoforming, reaction injection molding, and compression molding and, if necessary, followed by secondary die-cutting or in-mold die cutting. Representative methods are taught, for example, in U.S. Pat. Nos. 3,489,594; 3,530,489 4,257,176; 4,185,402; 4,586,273, in the Handbook of Plastics, Herber R. Simonds and Carleton Ellis, 1943, New York, N.Y., Reaction Injection Molding Machinery and Processes, F. Melvin Sweeney, 1987, New York, N.Y., and Flexible Polyurethane Foams, George Woods, 1982, New Jersey, whose preparative teachings are incorporated herein by reference. Preferably, the innersole is prepared by a foam reaction molding process such as taught in U.S. Pat. No. 4,694,589.

During use, insole 10 is placed in a shoe so that the medial side containing raised arch portion 16 rests against the inside of the shoe. Forefoot portion 12 may end just in front of the metatarsals. Insole 10 is a full length insole, that is, extends along the entire foot.

Figure 11:
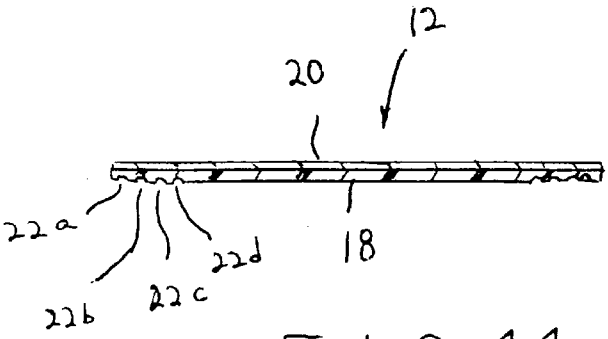
FIG. 11 is a cross-sectional view of the left insole, taken along line 11—11 of FIG. 5.

Typically, insole 10 would be sized corresponding to shoe sizes and would be provided in sized pairs. Alternatively, insole 10 may be trimmed to the requirements of the user. In this regard, arcuate pattern trim lines 22*a*–22*d* may be formed on the lower surface of forefoot portion 12 of insole 10, and which are representative of various sizes of the human foot. For example, insole 10 may be provided for a woman's shoe size of 10 . 11, with first continuous pattern trim line 22*a* being representative of a smaller size insole for a woman's shoe size 9, second continuous pattern trim line 22*b* extending around the periphery of toe portion 12 indicative of another size of insole for a woman's shoe size 8, third continuous pattern trim line 22*c* extending around the periphery of toe portion 12 indicative of another size of insole for a woman's shoe size 7, and fourth continuous pattern trim line 22*d* extending around the periphery of toe portion 12 indicative of another size of insole for a woman's shoe size *6*. If the user requires a size other than the original large size, the wearer merely trims the insole with a scissors or cutting instrument, using pattern trim lines 22*a*–22*d*, to achieve the proper size. The pattern trim lines may be imprinted by conventional printing techniques, silkscreening and the like. As an alternative, pattern trim lines 22*a*–22*d* may be formed as shallow grooves, as shown in FIG. 11, or be perforated, so that a smaller size insole may be separated by tearing along the appropriate trim lines, which tearing operation is facilitated by the inclusion of perforations. Thus, forefoot portion 12 can be trimmed so that forefoot portion 12 fits within the toe portion of a shoe.

In accordance with the present invention, insole 10 is formed with a structure to alleviate back and other pain in pregnant women. Specifically, insole 10 is a full length insole that reorients the foot to reduce overpronation while shifting the person slightly forwardly in order change the center of gravity of the person, and also providing cushioning at the ball of the foot. This effect is achieved with a number of structural enhancements to insole 10.

Specifically, a first structural enhancement is provided by the varus at heel portion 14. In this regard, the thickness of heel portion 14 is increased at the arch or medial side in order to provide a side to side slope or varus. This results in correction of the foot orientation at the heel strike, and particularly, prevents the foot from everting, that is, moving inwardly in the direction of the midline of the body. Preferably, the angular range of the varus is approximately 2 degrees to 7 degrees, with an optimum varus angle of approximately 5 degrees.

In accordance with a modification, it has been found by the inventors herein that the navicular differential for the arch of the left foot is greater than that for the arch of the right foot. The navicular differential is a basis for measurement with the foot in the neutral position. In effect, the arch height is taken at the navicular position and then drops down to define the flexibility of the arch. The greater the range of motion of the arch, the more probable that there is an overpronation problem.

This difference in navicular differential between the left and right feet indicates that there is more pronation in a person's left foot than their right foot. As a result, more overpronation control is warranted in left insole 10 in comparison with right insole 11. For this reason, in accordance with a modification of the present invention, left insole 10 is provided with a varus in the range of approximately 3 degrees to 9 degrees, with an optimum varus angle of approximately 7 degrees, and right insole 11 is provided with a varus in the range of approximately 2 degrees to 7 degrees, with an optimum varus angle of approximately 5 degrees. The varus extends along the entire width of the heel, from the medial side to the lateral side, contrary to U.S. Pat. No. 5,174,052 to Schoenhaus et al.

A second structural enhancement is provided by the cupped arrangement of heel portion 14. Specifically, as shown, heel portion 14 includes a relatively flat central portion 14*a*, and a sloped side wall 14*b*. Generally, when a heel strikes a surface, the fat pad portion of the heel spreads out. The cupped heel portion thereby stabilizes the heel of the person and maintains the heel in heel portion 14, to prevent such spreading out of the fat pad portion of the heel, and to also prevent any side to side movement of the heel in heel portion 14. This ensures that the varus operates properly on the foot.

A third structural enhancement is medial arch portion 16, which operates in conjunction with the varus, and also operates to prevent overpronation or flattening of the foot. With the present invention, medial arch portion 16 thereby starts further back than conventional arch portions.

Specifically, medial arch portion 16 begins a little behind the medial anterior portion of the calcaneous, that is, a little behind the front of heel portion 14 at the medial side. More specifically, medial arch portion 16 extends rearwardly as far back as the middle of heel portion 14 at the medial side. This provides a continuous control of motion in conjunction with the varus at heel portion 14. Further, medial arch portion 16 extends forwardly to approximately the first metatarsal of the foot supported thereby. In addition, medial arch portion 16 extends no greater than about 50% of the width of the insole.

A fourth structural enhancement is the fact that the side wall 14*b* of heel portion 14 extends forwardly as a lateral flange or side wall 16*b*. Lateral side wall 16*b* functions to prevent the foot from abducting, that is, moving away from the midline of the body. Lateral side wall 16*b* operates primarily during the forefoot part of the stride, and thereby prevents splaying out of the foot while walking. Lateral side wall 16*b* thereby starts at heel portion 14 and extends at least to a midpoint of the insole, tapering off near the metatarsals or ball of the foot. In effect, since the direction a foot takes is determined in large part by the metatarsals, lateral side wall 16*b* drives against an outward splaying direction during roll off from the big toe.

A fifth structural enhancement is formed by a downward slope from the back of heel portion 14 to the front of medial arch portion 16. Specifically, it has been found by the inventors herein that pregnant women arch their back rearwardly to counterbalance and maintain equilibrium. This places a great force on the rear of the feet. By directing the body forwardly, there is a decrease in pressure on the rear of the feet, and a consequent decrease in pressure on the person's back. Preferably, the downward slope is in a range greater than zero degrees and not greater than approximately 5 degrees, with an optimum slope of approximately 2 degrees. Further, the slope can be made at different angles for insoles corresponding to different trimesters. This is because, as pregnancy progresses, there is a tendency to arch further back to counterbalance and maintain equilibrium, due to the increased weight and the shift in weight. This aspect is contrary to that of the aforementioned U.S. Pat. No. 4,408,402 to Looney which teaches away from this enhancement.

Because of this shift forwardly, a sixth aspect of the present invention is the requirement that insoles 10 and 11 preferably be full length insoles, each with a forefoot portion 12, to compensate for the increased pressure on the forefoot.

Tests were performed with insoles 10 and 11. Specifically, in a first test, 30 pregnant women were evaluated over a four week period with insoles 10 and 11. The insoles provided significant relief of lower back pain after only one week, and specifically, provided an average 48% reduction in lower back pain after one week, and an average 72% reduction in lower back pain after four weeks.

In a second test, 75 pregnant women were randomly assigned to three groups. A first group evaluated insoles 10 and 11 constructed as a one part construction of a molded polyurethane, while a second group evaluated insoles 10 and 11 constructed as a two part construction of widely different material constructions of a multilayer EVA/polyurethane construction. The third group evaluated a control insole formed as a full length flat insole.

Figure 12:
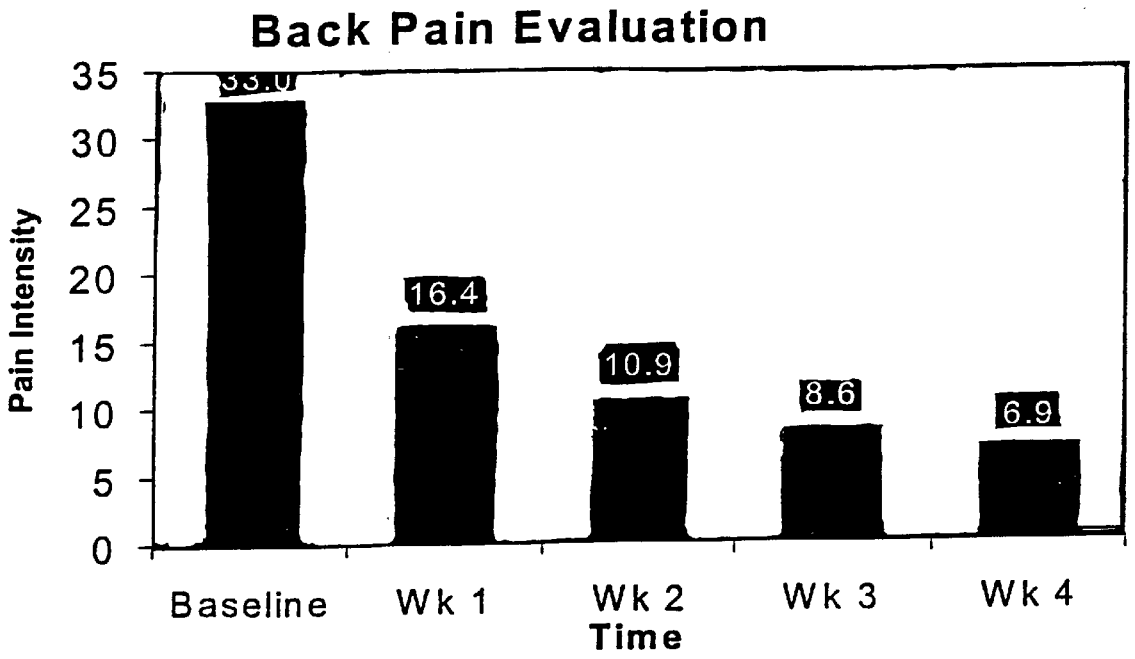
FIG. 12 is a graphical diagram of back pain intensity over time with the insoles according to the present invention.

The insoles of the first and second groups provided significant relief of lower back pain after only one week. Insoles 10 and 11 of the first group provided an 80% reduction in lower back pain after four weeks, as shown in FIG. 12. Similarly, statistically significant relief of hip, leg and foot pain was also realized. The subjects of the first group were then enrolled in a further study after a ten day wash-out period using the control insole formed as a full length flat insole. The majority of subjects noted a resumption of lower back pain and/or lower extremity pain during a four week period using the flat insole.

Although the present invention uses the term insole, it will be appreciated that the use of other equivalent or similar terms such as innersole or insert are considered to be synonymous and interchangeable, and thereby covered by the present claimed invention.

Further, although the present invention has been discussed in relation to a removable insole, it can be incorporated as a permanent inner sole in footwear, such as a shoe or the like.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention as defined by the appended claims.

What is claimed is:

1. A removable insole for insertion into footwear, comprising:

a forefoot portion for extending at least to metatarsals of a foot;

a heel portion having a varus in the range of approximately 2 degrees to 9 degrees which slopes from a medial side of the insole to a lateral side of the insole, wherein said varus is preferably approximately 7 degrees for one foot and approximately 5 degrees for another foot;

a medial arch portion connecting together said forefoot portion and said heel portion; and an upper surface extending along said forefoot, arch and heel portions, and having a downward inclination from said heel portion to a front section of said arch portion in a range greater than zero degrees and not greater than approximately 5 degrees.

2. A removable insole according to claim 1, wherein said heel portion is thicker at the medial side of the insole than at the lateral side of the insole to provide said varus.

3. A removable insole according to claim 1, wherein said downward inclination is approximately 2 degrees.

4. A removable insole according to claim 1, wherein said heel portion is cupped to maintain said heel in said heel portion in order for said varus to operate on a heel of a foot supported thereby.

5. A removable insole according to claim 4, wherein said cupped heel portion is formed by a relatively flat central portion and a sloped side wall.

6. A removable insole according to claim 1, wherein said medial arch portion extends rearwardly of a front section of said heel portion.

7. A removable insole according to claim 1, further comprising a lateral flange extending around a periphery of at least said heel portion and extending forwardly at least to a midfoot portion of the insole to prevent abduction of a foot supported thereby.

8. A removable insole according to claim 1, further comprising a top cover secured to said upper surface.

9. A removable insole according to claim 1, further comprising at least one pattern trim line at the forefoot portion for trimming the insole to fit into smaller size footwear.

10. A removable insole according to claim 1, wherein said medial arch portion extends no greater than about 50% of a width of the insole.

11. Footwear comprising:

an outer sole;

an inner sole connected to said outer sole, said inner sole including:

a forefoot portion for extending at least to metatarsals of a foot;

a heel portion having a varus in the range of approximately 2 degrees to 9 degrees which slopes from a medial side of the inner sole to a lateral side of the inner sole, wherein said varus is preferably approximately 7 degrees for one foot and approximately 5 degrees for another foot a medial arch portion connecting together said forefoot portion and said heel portion;

an upper surface extending along said forefoot, arch and heel portions, and having a downward inclination from said heel portion to a front section of said arch portion in a range greater than zero degrees and not greater than approximately 5 degrees; and an upper connected to at least one of said outer sole and said inner sole.

12. Footwear according to claim 11, wherein said heel portion is thicker at the medial side of the inner sole than at the lateral side of the inner sole to provide said varus.

13. Footwear according to claim 11, wherein said downward inclination is approximately 2 degrees.

14. Footwear according to claim 11, wherein said heel portion is cupped to maintain said heel in said heel portion in order for said varus to operate on a heel of a foot supported thereby.

15. Footwear according to claim 14, wherein said cupped heel portion is formed by a relatively flat central portion and a sloped side wall.

16. Footwear according to claim 11, wherein said medial arch portion extends forwardly to approximately a first metatarsal of a foot supported thereby.

17. Footwear according to claim 11, wherein said medial arch portion extends rearwardly of a front section of said heel portion.

18. Footwear according to claim 11, further comprising a lateral flange extending around a periphery of at least said heel portion and extending forwardly at least to a midfoot portion of the inner sole to prevent abduction of a foot supported thereby.

19. Footwear according to claim 11, further comprising a top cover secured to said upper surface.

20. Footwear according to claim 11, wherein said medial arch portion extends no greater than about 50% of a width of the inner sole.

* * * * *